US007446641B2

(12) United States Patent
Fushimi

(10) Patent No.: US 7,446,641 B2
(45) Date of Patent: Nov. 4, 2008

(54) BALANCE TRANSFORMER

(75) Inventor: Tadayuki Fushimi, Tokyo (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 11/798,868

(22) Filed: May 17, 2007

(65) Prior Publication Data

US 2007/0268103 A1 Nov. 22, 2007

(30) Foreign Application Priority Data

May 18, 2006 (JP) ..... 2006-138841
Mar. 26, 2007 (JP) ..... 2007-078867

(51) Int. Cl.
*H01F 27/24* (2006.01)

(52) U.S. Cl. ..... 336/212

(58) Field of Classification Search ..... 336/65, 336/83, 170, 178, 200, 212, 220–222
See application file for complete search history.

(56) References Cited

U.S. PATENT DOCUMENTS 6,781,325 B2 8/2004 Lee
7,180,399 B2 * 2/2007 Chung ..... 336/212
7,301,430 B1 * 11/2007 Chan et al. ..... 336/200
7,345,565 B2 * 3/2008 Yang et al. ..... 336/200

FOREIGN PATENT DOCUMENTS

| | | |
|---|---|---|
| JP | 2003-031383 | 1/2003 |
| JP | 2006-012781 | 1/2006 |
| WO | WO 2005/038828 | 4/2005 |

* cited by examiner

*Primary Examiner*—Tuyen T. Nguyen
(74) *Attorney, Agent, or Firm*—Oliff & Berridge, PLC

(57) ABSTRACT

A small loop path 9A composed of a part of each of a first core 51 and a second core 52 is disposed with two windings 2A and 3A of a transformer portion 4A, and a small loop path 9B composed of another part of each of the first core 51 and the second core 52 is disposed with two windings 2B and 3B of a transformer portion 4B. A magnetic flux generated at the transformer portion 4A circulates along the small loop path 9A, and a magnetic flux generated at the transformer portion 4B circulates along the small loop path 9B with each flux circulating in a mutually reverse direction.

9 Claims, 3 Drawing Sheets

BALANCE TRANSFORMER

RELATED APPLICATIONS

This application claims the priority of Japanese Patent Application No. 2006-138841 filed on May 18, 2006 and Japanese Patent Application No. 2007-78867 filed on Mar. 26, 2007, which are incorporated herein by reference.

BACKGROUND OF THE INVENTION

1. Field of the Invention

The present invention relates to a balance transformer used in a circuit for parallel-driving a plurality of discharge lamps to balance current shunted to the plurality of discharge lamps, and in particular, to a balance transformer suitable for use in a DC/AC inverter circuit for parallel-driving cold cathode fluorescent lamps (CCFL) for back light of various types of display panels used for Laptops, liquid crystal televisions, and the like.

2. Description of the Prior Art

Heretofore, as a parallel-drive circuit of CCFL, for example, those disclosed in International Patent Publication No. WO2005/038828, U.S. Pat. No. 6,781,325, and Japanese Unexamined Patent Publication No. 2003-31383 are known.

Further, Japanese Unexamined Patent Publication No. 2006-12781 proposes a balance transformer disposed with a plurality of transformer portions comprising a primary winding and a secondary winding disposed coaxially applicable to a parallel drive circuit of the CCFL of this type, particularly as a balance transformer applicable to the parallel drive circuit disclosed in the International Patent Publication No. WO2005/038828.

The balance transformer disclosed in the above described Japanese Unexamined Patent Publication No. 2006-12781 can be broadly classified into three types in its specific mode. A first type is disposed with a plurality of transformer portions in series, and at the same time, is disposed with a loop-shaped common core communicated to the interior of the winding of each transformer (see FIGS. 11, 12, and 14 of the above described Japanese Unexamined Patent Publication No. 2006-12781). A second type is disposed with a plurality of transformer portions in parallel, and at the same time, is disposed with a common core provided with a plurality of leg portions inserted into the interior of the winding of each transformer, respectively (see FIG. 13 of the above described Japanese Unexamined Patent Publication No. 2006-12781). Further, a third type is disposed with an individual core for each of the plurality of transformer portions disposed in parallel (see FIG. 15 of the above described Japanese Unexamined Patent Publication No. 2006-12781).

However, the balance transformers of the first and second type are liable to cause magnetic interference since a magnetic path for each magnetic flux generated at each transformer portion is mutually not isolated, and there is a fear that an accuracy of the operation for balancing the current to each CCFL is lowered.

On the other hand, though each magnetic path is mutually isolated by providing a separate core for each transformer, the balance transformer of the third type is hardly able to attempt at the miniaturization of the individual transformer portion because of the requirement of a core for each transformer portion, and at the same time, the number of component parts of each transformer portion is increased, thereby causing a problem of the increase in the cost of production.

SUMMARY OF THE INVENTION

The present invention has been made in view of the above described circumstances, and an object of the invention is to provide a balance transformer in which the magnetic flux generated at each transformer portion hardly causes magnetic interference, and moreover, the number of component parts is reduced with the component parts miniaturized, and the low cost can be attempted.

The balance transformer according to the present invention is a balance transformer disposed in a circuit for driving a plurality of discharge lamps, and comprises:

- a first transformer portion having a first primary winding and a first secondary winding;
- a second transformer portion having a second primary winding and a second secondary winding; and
- a magnetic core comprising a loop-shaped outer frame portion and a short portion for shorting inside of the outer frame portion,
- wherein a first small loop path composed of a part of the outer frame portion and the short portion is disposed with only two windings of the first transformer portion from among all the windings, and a second small loop path composed of another part of the outer frame portion and the short portion is disposed with only two windings of the second transformer portion from among all the windings, and
- wherein a first magnetic flux generated at the first transformer portion circulates along the first small loop path, and a second magnetic flux generated at the second transformer portion circulates along the second small loop path in a direction reverse to the first magnetic flux.

Further, in the balance transformer of the present invention, the four windings are approximately coaxially disposed, and the magnetic core is composed of a combination of a bar-shaped first core disposing in each interior of the four windings and a second core coupled with the first core.

Still further, in the balance transformer of the present invention, the second core is mutually and integrally formed with a base portion extending in parallel to the first core; with outer leg portions protruding toward the first core at both end portions of the base portion, respectively; and with a middle leg portion protruding toward the first core at a central portion of the base portion.

Moreover, in the balance transformer of the present invention, the first secondary winding and the second secondary winding are wound by being split into a plurality of wound sections, respectively, and each width of the plurality of wound sections are set to become larger than the width of each wound region of the first primary winding and the second primary winding.

In addition, in the balance transformer of the present invention, a bobbin wound with all windings is disposed with a primary side terminal connected with the first primary winding and the second primary winding and a secondary side terminal connected with the first secondary winding and the second secondary winding at mutually different side surfaces of the bobbin, respectively.

Still further, in the balance transformer of the present invention, between the first primary winding and the first secondary winding in the first transformer portion, and between the second primary winding and the second secondary winding in the second transformer portion, an insulating wall is disposed, respectively, and the insulating wall is provided with a groove portion.

Further, in accordance with the balance transformer of the present invention, the first transformer portion and the second transformer portion are mutually coupled through a coupling portion, and the coupling portion is disposed with an opening portion for exposing a part of the magnetic core.

Moreover, in the balance transformer of the present invention, two of the short portions are provided, and the first small loop path and the second small loop path are configured to pass through a separate short portion, respectively.

In addition, in accordance with the balance transformer of the present invention, another side surface of the bobbin is provided with a wall portion for positioning the magnetic core.

DETAILED DESCRIPTION OF THE PREFERRED EMBODIMENTS

An embodiment of a balance transformer according to the present invention will be described below in detail with reference to each drawing accompanied herewith. FIGS. 1 to 4 show the embodiment of the balance transformer according to the present invention. Incidentally, three dimensional orthogonal coordinate system shown in each Figure shows a corresponding relationship of the aspects between the Figures, and according to the following description, the direction of an axis X of the three dimensional orthogonal coordinate system can be referred to as the front to back (an arrow direction is front), the direction of an axis Y as the left to right (an arrow direction is the right), and the direction of an axis Z as the upward to downward (direction of the arrow is upward).

Figure 1:
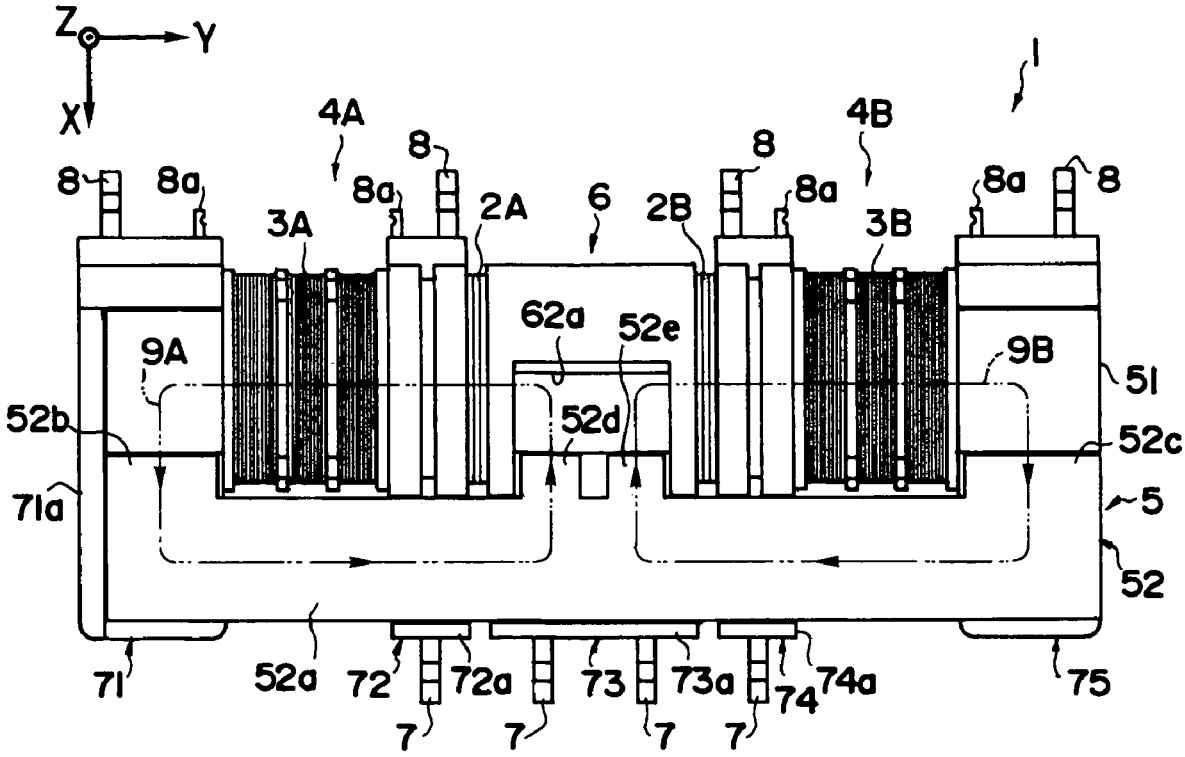
FIG. 1 is a top plan view showing the entire configuration of a balance transformer according to a first embodiment.
Figure 2:
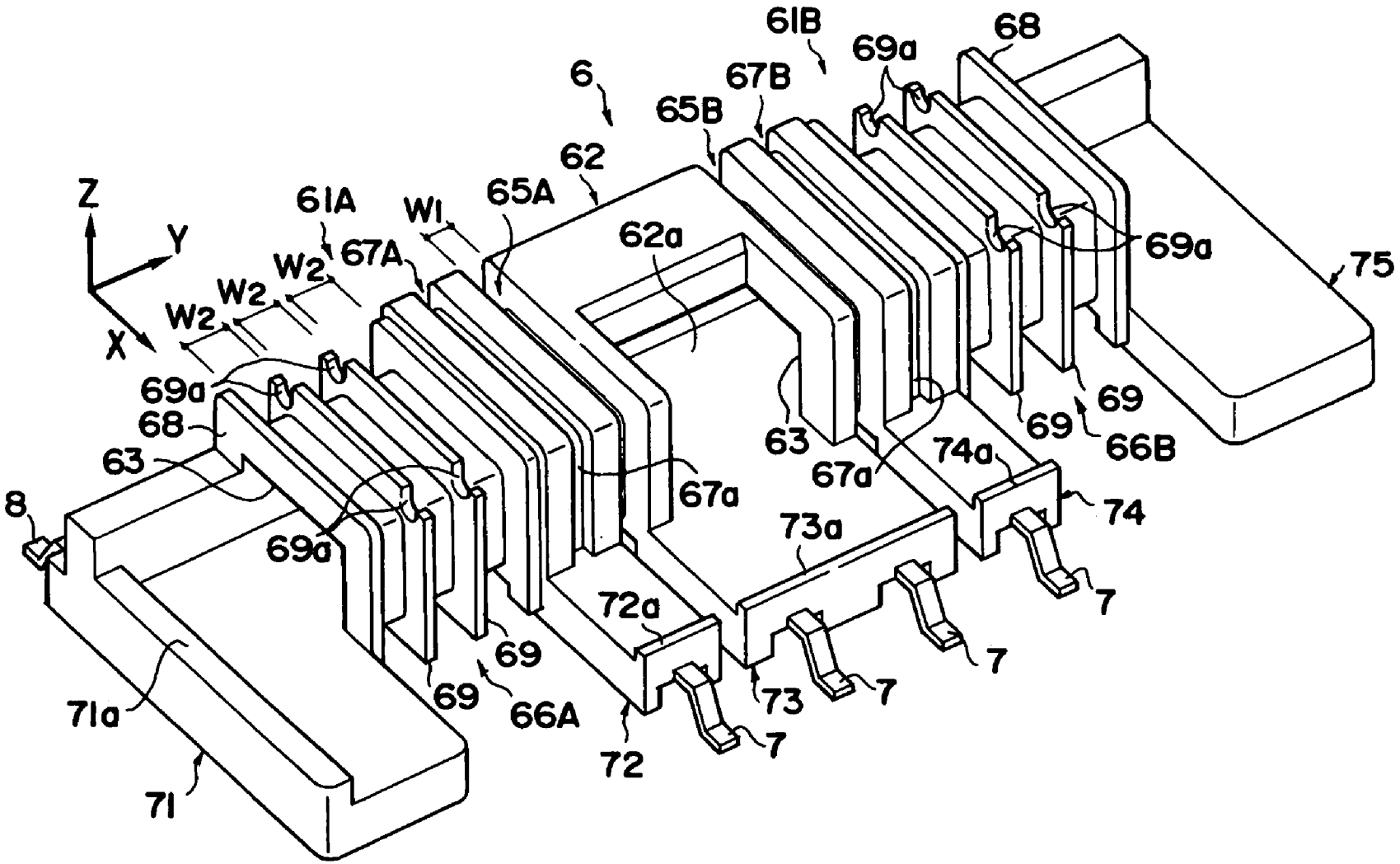
FIG. 2 is an oblique view from a front side of a bobbin shown in FIG. 1.
Figure 3:
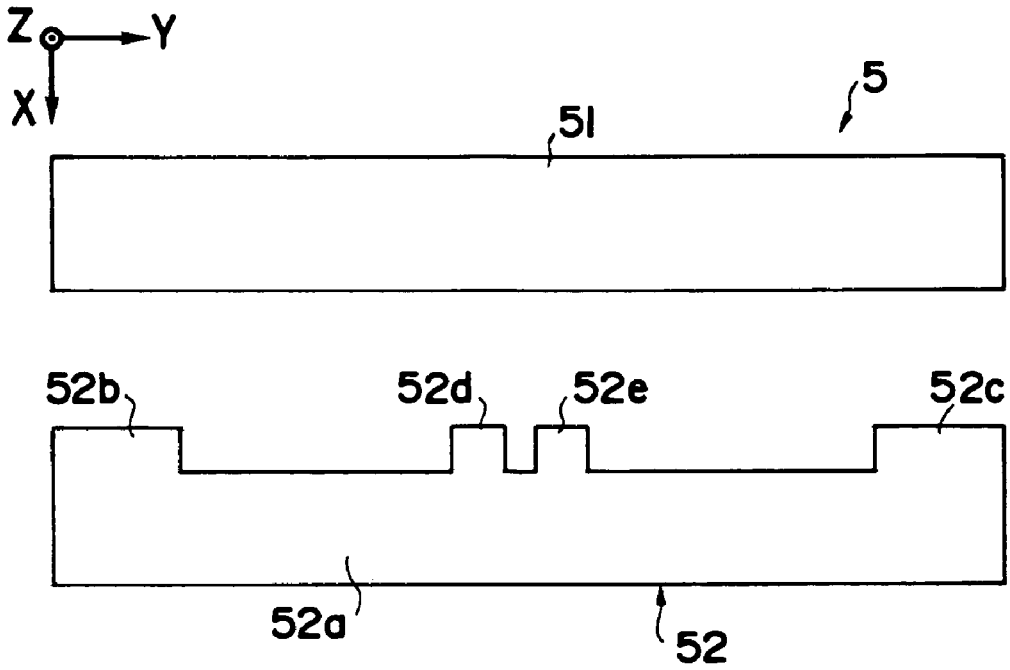
FIG. 3 is an exploded view of a magnetic core shown in FIG. 1.

First, using FIGS. 1 to 3, a configuration of the balance transformer according to one embodiment of the present invention will be described. FIG. 1 is a top plan view showing the entire configuration of the balance transformer according to one embodiment of the present invention, FIG. 2 is an oblique view from a front side of a bobbin shown in FIG. 1, and FIG. 3 is an exploded view of a magnetic core shown in FIG. 1.

A balance transformer 1 of the present embodiment, for example, is used for balancing the current shunted to a plurality of CCFLs in a DC/AC inverter circuit which discharges and lights a cold cathode fluorescent lamp (CCFL) for use of back light of various types of display panels used for Laptops, liquid crystal televisions, and the like, and as shown in FIG. 1, is provided with a first transformer portion 4A comprising a first primary winding 2A and a first secondary winding 3A, a second transformer portion 4B comprising a second primary winding 2B and a second secondary winding 3B, and a magnetic core 5.

The four windings 2A, 3A, 2B and 3B are wound around a bobbin 6 formed by an insulating material such as a plastic resin. This bobbin 6, as shown in FIG. 2, is formed by mutually integrating a first winding axis portion 61A disposed with the first transformer portion 4A, a second winding axis portion 61B disposed with the second transformer portion 4B, and a coupling portion 62 disposed between the first and second winding axis portions 61A and 61B. The first and second winding axis portions 61A and 61B are formed with a core insertion hole 63 extending in the left to right direction (direction Y in the Figure), respectively, and the coupling portion 62 is formed with an opening portion 62*a* to allow a part of the magnetic core 5 inserted into the core insertion hole 63 (for further detail, a first core 51 to be described later) to be exposed.

Incidentally, the opening portion 62*a* is for performing the coupling with middle leg portions 52*d*, 52*e*, and 52*f* of a first core 51 and a second core 52 to be described later. By providing such opening portion 62*a*, a creepage distance from the first transformer portion 4A and the second transformer portion 4B to the middle leg portions 52*d*, 52*e*, and 52*f* of the second core 52 becomes long, and insulation properties can be sufficiently secured.

To be more in detail, the first winding axis portion 61A comprises a first primary side winding portion 65A wound with the first primary winding 2A, a first secondary side winding portion 66A wound with the first secondary winding 3A, and a first insulating wall portion 67A disposed between these first primary side winding portion 65A and first secondary side winding portion 66A. The first secondary side winding portion 66A is split into three winding sections by an end flange 68 and two partition flanges 69, and each winding section is configured to be wound with approximately one third of the first secondary winding 3A. Further, each partition flange 69 is formed with a notch portion 69*a* for delivering the first secondary winding 3A to adjacent winding sections.

Further, a width (a length in the direction to Y in Figure) $W_2$ of each winding section of the first secondary side winding portion 66A is formed to be larger than a width $W_1$ of a winding area of the first primary side winding portion 65A. As a result, as against the number of windings (for example, about 10 T) of the first primary winding 2A wound around the first primary side winding portion 65A, the number of windings of the first secondary winding 3A wound around the first secondary side winding portion 66A (for example, about 300 T for each winding section, and a total of about 900 T) can be increased to a large extent. By producing difference in the number of windings between the first primary winding 2A and the first secondary winding 3A, potential difference between both ends of the first primary winding 2A can be suppressed low.

However, when the difference is thus produced in the number of windings, potential difference between the first primary winding 2A and the first secondary winding 3A becomes large, and therefore, a sufficient attention must be paid to ensure insulation between these windings. The present embodiment is configured such that the width (the length in the direction to Y in Figure) of the first insulating wall portion 67A is sufficiently secured, and at the same time, a groove portion 67*a* is formed in its peripheral surface, thereby making the creepage distance between the first primary side winding portion 65A and the first secondary side winding portion 66A long so that a sufficient insulation can be obtained.

On the other hand, the second winding axis portion 61B comprises a second primary side winding portion 65B wound with the second primary winding 2B, a second secondary side winding portion 66B wound with the second secondary winding 3B, and a second insulating wall portion 67B disposed between these second primary side winding portion 65B and second secondary side winding portion 66B. The configurations of these second primary side winding portion 65B, second secondary side winding portion 66B, and second insulating wall portion 67B are the same as the configurations of the first primary side winding portion 65A, first secondary side winding portion 66A, and first insulating wall portion 67A in the above described first winding axis portion 61A, and therefore, the detailed description thereof will be omitted.

Further, the bobbin 6 is integrally formed with five terminal supports 71 to 75. As shown in FIG. 1, the terminal support 73 holds two primary side terminals 7 protruding in front (downward in the Figure), and the terminal supports 72 and 74 hold one each of a primary side terminal 7 protruding in front and a secondary side terminal 8 protruding at the back (upward in the Figure). The terminal supports 71 and 75 hold secondary side terminal 8 projecting backward, one for each. Each end portion of the first secondary winding 3A is configured to be connected to an entwining portion 8*a* of each secondary side terminal 8 of the terminal supports 71 and 72, and each end portion of the second secondary winding 3B is configured to be connected to an entwining portion 8*a* of each secondary side terminal 8 of the terminal supports 74 and 75. Further, each end portion of the first primary winding 2A and each end portion of the second primary winding 2B are configured to be connected to the primary side terminal 7 of any of the terminal supports 72 to 74.

Thus, the primary side terminal 7 and the secondary side terminal 8 are disposed at mutually different side surfaces of the bobbin 6, particularly desirably disposed at mutually opposing side surfaces, so that the insulating properties with the primary windings 2A and 2B, and the secondary windings 3A and 3B can be sufficiently secured. Further, the parts layout and routing of the wirings on a circuit board can be simplified. Incidentally, from among each of the secondary side terminals 8, particularly those connected to the high voltage sides of the secondary windings 3A and 3B may be disposed at the side surfaces mutually different from the side surfaces disposed with the primary side terminal 7, and those connected to the low voltage sides are not necessarily disposed in the same manner.

Further, as shown in FIG. 2, the upper surface of the terminal support 71 is provided with a wall portion 71*a* extending along the left edge portion, and the terminal supports 72 to 74 are provided with wall portions 72*a* to 74*a* extending along the front edge portion, respectively.

By providing the wall portions 71*a*, and 72*a* to 74*a* in this manner, the positioning of the core can be made, so that the fluctuation of the characteristic by displacement of the core can be suppressed.

On the other hand, as shown in FIG. 3, the magnetic core 5, for example, is configured by mutually combining the first core 51 and the second core 52 formed respectively by a ferrite of soft magnetic material (in addition, materials such as permalloy, sendust, and iron carbonyl, and dust core which compression-moulds these fine particles can be used).

The first core 51 formed in the shape of a bar is configured to be inserted into the core insertion hole 63 from the right end side of the second secondary side winding axis portion 61B shown in FIG. 2, and held inside the bobbin 6 in a state in which its left end portion contacts with the wall portion 71*a* of the terminal support 71 (see FIG. 1).

In contrast to this, the second core 52, as shown in FIG. 3, is configured by being mutually and integrally formed with a base portion 52*a* extending in parallel with the first core 51, outer leg portions 52*b* and 52*c* protruding toward the first core 51 at both ends of the base portion 52*a*, respectively, and the middle leg portions 52*d* and 52*e* protruding toward the first core 51 in the center portion of the base portion 52*a*, respectively. This second core 52, as shown in FIG. 1, is disposed such that the two middle leg portions 52*d* and 52*e* contact with the front surface of the first core 51 between the first transformer portion 4A and the second transformer portion 4B so that the two outer leg portions 52*b* and 52*c* contact with the front surface of the first core 51 at the left end side and the right end side of the first core 51, respectively.

Incidentally, in the present embodiment, a loop-shaped outer frame portion is composed of the base portion 52*a* of the second core 52, two outer legs portions 52*b* and 52*c*, and the first core 51, and a short portion for shorting the interior of the outer frame portion is composed of the two middle leg portions 52*d* and 52*e* of the second core 52.

Further, the first small loop path 9A is composed of approximately the left half of the first core 51 disposed as shown in FIG. 1, approximately the left half of the base portion 52*a* of the second core 52, and the outer leg portion 52*b* of the left side and the middle leg portion 52*d* of the left side, and a second small loop path 9B is composed of approximately right half of the first core 51, approximately right half of the base portion 52*a* of the second core 52, and the outer leg portion 52*c* of the right side and the middle let portion 52*e* of the right side.

As shown in FIG. 1, the first small loop path 9A is disposed with two windings 2A and 3A only of the first transformer portion 4A from among the four windings 2A, 3A, 2B and 3B, and the second small loop path 9B is disposed with two windings 2B and 3B only of the second transformer portion 4B from among the four windings 2A, 3A, 2B, and 3B. A first magnetic flux generated at the first transformer portion 4A circulates along the first small loop path 9A, and a second magnetic flux generated at the second transformer portion 4B circulates along the second small loop path 9B in a direction reverse to the first magnetic flux.

As a result, in the balance transformer 1 of the present embodiment, a magnetic path by the first magnetic flux generated at the first transformer portion 4A and a magnetic path by the second magnetic flux generated at the second transformer portion 4B can be mutually isolated. Consequently, the magnetic interference by the two magnetic fluxes can be prevented, and a balancing accuracy of the current toward each CCFL can be improved.

Figure 4:
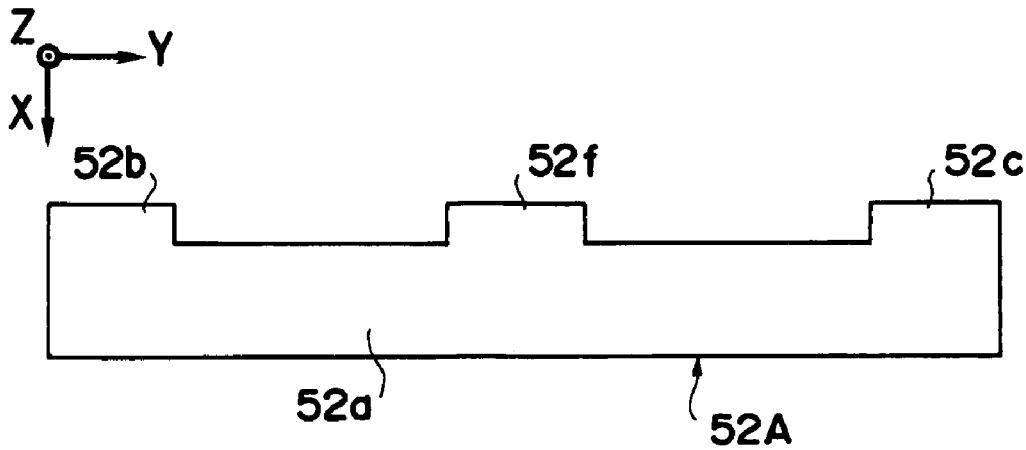
FIG. 4 is a view showing a modified example of a second core.

Incidentally, though the second core 52 is provided with two middle leg portions 52*d* and 52*e* comprising the short portion, the short portion may be composed of one middle leg portion 52*f* similarly to the second core 52A of the modified example shown in FIG. 4. In this case, the first small loop path 9A and the second small loop path 9B are common in the middle leg portion 52*f*. While the magnetic flux has properties to pass through preferably the shortest possible magnetic path, a magnetic interference is slightly generated in the middle leg portion 52*f* in which the two small loop paths 9A and 9B are common. However, no significant trouble arises in the characteristics of the circuit. On the other hand, the advantage is afforded to be able to reduce the cost of production owing to the simplification of the core shape.

Further, though the four windings 2A, 3A, 2B, and 3B are approximately coaxially disposed, these disposing positions can be suitably changed if the two windings 2A and 3A only of the first transformer portion 4A are disposed on the first small loop path 9A, and the two windings 2B and 3B only of the second transformer portion 4B are disposed on the second small loop path 9B. For example, in the first transformer portion 4A, the first primary winding 2A can be disposed at the first core 51 side, and the first secondary winding 3A can be disposed at the second core 52 side, and these windings can be also disposed at the outer leg portion 52*b* or the middle leg portion 52*d* of the second core 52 (the same disposition can be made also in the second transformer portion 4B).

Further, the terminal arrangements may be appropriately changed from those in the embodiment.

Further, though the above described embodiment shows an embodiment comprising two transformer portions of the first transformer portion 4A and the second transformer portion 4B, the number of the transformer portions is not limited to two, but a third transformer portion and a fourth transformer portion may be appropriately added.

The balance transformer of the present invention is configured such that the first magnetic flux generated at the first transformer portion circulates along the first small loop path composed of a part of the magnetic core, and the second magnetic flux generated at the second transformer portion circulates along the second small loop path composed of another part of the magnetic core in a direction reverse to the first magnetic flux. Consequently, the magnetic path of the first magnetic flux and the magnetic path of the second magnetic flux can be mutually isolated, so that the magnetic interference by the two magnetic fluxes can be prevented, and a balancing accuracy of the current toward each discharge lamp can be improved similarly to the case where a separate core is provided for each transformer portion.

Further, the magnetic core is configured to be composed of the loop-shaped outer frame portion and the short portion, so that the first and second transformer portions can use a common magnetic core. Thus, comparing with the conventional art provided with a separate core for each transformer portion, the number of component parts can be made small, thereby the reduction in size and cost can be attempted.

What is claimed is:

1. A balance transformer disposed in a circuit for driving a plurality of discharge lamps, comprising:

a first transformer portion having a first primary winding and a first secondary winding;

a second transformer portion having a second primary winding and a second secondary winding; and a magnetic core composed of a loop-shaped outer frame portion and a short portion to short inside of said outer frame portion, wherein a first small loop path composed of a part of said outer frame portion and said short portion is disposed with only two windings of said first transformer portion from among all windings, and a second small loop path composed of another part of said outer frame portion and said short portion is disposed with only two windings of said second transformer portion from among all windings, and wherein a first magnetic flux generated at said first transformer portion circulates along said first small loop path, and a second magnetic flux generated at said second transformer portion circulates along said second small loop path in a direction reverse to said first magnetic flux.

2. The balance transformer according to claim 1, wherein said four windings are approximately coaxially disposed, and wherein said magnetic core is composed of a combination of a bar-shaped first core disposing in each interior of said four windings and a second core coupled with said first core.

3. The balance transformer according to claim 2, wherein said second core is mutually and integrally formed with a base portion extending in parallel to said first core; with outer leg portions protruding toward said first core at both end portions of said base portion, respectively; and with a middle leg portion protruding toward said first core at a central portion of said base portion.

4. The balance transformer according to claim 1, wherein said first secondary winding and said second secondary winding are wound by being split into a plurality of wound sections, respectively, and wherein each width of said plurality of wound sections are set to become larger than the width of each wound region of said first primary winding and said second primary winding.

5. The balance transformer according to claim 1, wherein a bobbin wound with all windings is disposed with a primary side terminal connected with said first primary winding and said second primary winding and a secondary side terminal connected with said first secondary winding and said second secondary winding at mutually different side surfaces of said bobbin, respectively.

6. The balance transformer according to claim 1, wherein between said first primary winding and said first secondary winding in said first transformer portion, and between said second primary winding and said second secondary winding in said second transformer portion, an insulating wall is disposed, respectively, and said insulating wall is provided with a groove portion.

7. The balance transformer according to claim 1, wherein said first transformer portion and said second transformer portion are mutually coupled through a coupling portion, and said coupling portion is disposed with an opening portion for exposing a part of said magnetic core.

8. The balance transformer according to claim 1, wherein two of said short portions are provided, and said first small loop path and said second small loop path are configured to pass through a separate short portion, respectively.

9. The balance transformer according to claim 1, wherein another side surface of a bobbin wound with all windings is provided with a wall portion for positioning said magnetic core.

* * * * *